United States Patent [19]

Wellard

[11] 4,267,634

[45] May 19, 1981

[54] METHOD FOR MAKING A CHIP CIRCUIT COMPONENT

[75] Inventor: Charles L. Wellard, Oaks, Pa.

[73] Assignee: American Components Inc., Conshohocken, Pa.

[21] Appl. No.: 893,288

[22] Filed: Apr. 5, 1978

[51] Int. Cl.[3] ..... H01C 17/06

[52] U.S. Cl. ..... 29/620; 29/621; 338/307

[58] Field of Search ..... 29/620, 621, 610 R, 29/613, 619; 338/307, 308

[56] References Cited

U.S. PATENT DOCUMENTS

| | | | |
|---|---|---|---|
| 3,193,611 | 7/1965 | Huetten | 29/619 |
| 3,551,195 | 12/1970 | Wada | 338/308 |
| 4,016,646 | 4/1977 | Pirotte | 29/610 R |

*Primary Examiner*—Lowell A. Larson
*Assistant Examiner*—Gene P. Crosby
*Attorney, Agent, or Firm*—William E. Cleaver

[57] ABSTRACT

The present method and device provides that a thickness of wet ceramic material is laid down and partially dried to provide a base. This step is followed by screen printing one or more patterns of electrical resistance material on the upper surface of the partially dried ceramic base. Thereafter a second thickness of said wet ceramic is laid down and partially dried. In the event that the fabricator desires to provide a plurality of resistance paths, or a capacitor, in a single package, the foregoing process can be repeated with additional patterns of resistance material laid down or conductor material for a capacitor laid down, on the upper layer of partially dried ceramic material. The resistance or conductor patterns are sandwiched by additional thicknesses of ceramic materials screen stacked thereon. When the desired package has been achieved, the multi layered arrangement is given a final drying and it is then diced and fired. Thereafter termination means are provided to the fired diced sections, thus making up chip components.

2 Claims, 9 Drawing Figures

METHOD FOR MAKING A CHIP CIRCUIT COMPONENT

BACKGROUND

At the present time, as part of the prior art, chip resistors are fabricated by starting with a fired ceramic plate. Terminal positions are screen printed onto the fired ceramic plate. Thereafter a pattern of electrical resistance material is screen printed on the fired ceramic plate and connected up to the terminal positions. Then the entire package is fired and the ceramic base with the fired material thereon is diced or cut into chips. Finally the chips have termination means secured to said terminal positions so that the entire end is solderable. Compared to the present invention, the prior art process is expensive. For instance, the difficulty in dicing the fired ceramic reduces the yield (and increase the expense) and the many individual steps taken before firing also add to the cost. The present invention enables the package to be diced before firing which reduces the difficulty in cutting the package into chips and increases the yield. The resistance material and the base (which are chosen to have closely matched coefficients of expansion) are fired at the same time and this practice eliminates steps and cuts costs. After a chip (or chips) has a termination means secured thereto it is a finished product. The construction of the present component provides environmental protection since the active layers are embedded in ceramic.

SUMMARY

The present method of fabricating a chip resistor provides that a thickness of wet ceramic material is laid down on a base plate or sheet. In the preferred embodiment this thickness of wet ceramic material is accomplished by silk screening or screen printing, or doctor blading, and after a plurality of layers of wet ceramic material has been developed it is partially dried. Thereafter a pattern of resistance material is silk screened or screen printed, or doctor bladed, onto the top of the uppermost partially dried ceramic layer. In the preferred embodiment, the pattern is a stripe although other patterns could be used. The width of the stripes, rather than the thickness or depth, is the most suitable parameter for determining the resistance value of the chips. However, it should be understood that the resistance value could be determined by the depth of the stripes or by the particular resistance material used (e.t. ohms per square value of a particular material).

After the stripes have been printed and partially dried a second series of layers of wet ceramic material is applied by silk screening, screen printing or doctor blading, onto the stripes of resistance material. The foregoing constitutes a basic package. A second set of stripes of resistance material could be printed on the last layer of the second series of the partially dried ceramic material and a third series of layers of wet ceramic material could be laid over the second set of stripes of resistance material, and so on, with partial drying between layers, until the desired number of resistance layers, sandwiched between ceramic layers, is obtained. This stacked arrangement can be an advantage not only in obtaining certain resistance values but also in the power rating as well. Thereafter the package is subjected to a final drying and then dried, i.e. cut into predetermined chip sizes. The chips are then fired, so that all of the chips are literally formed in their final ceramic state at one time. The resistance material patterns, in each chip, are disposed to abut at least two edges thereof. Thereafter termination means are secured to the individual chips, thereby creating a plurality of chip components (in the foregoing example, chip resistors).

The features and objects of the present invention will be better understood from the following description taken in conjunction with the drawings wherein.

Figure 1:
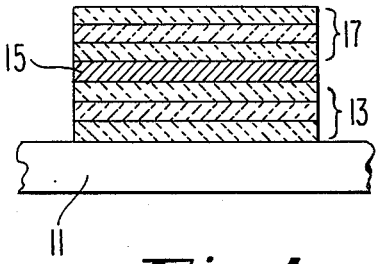
FIG. 1 is a cross sectional view of a plurality of layers of ceramic material arranged to sandwich a layer of electrical resistance material to form a basic unit.

Consider FIG. 1. In FIG. 1 there is shown a basic undiced and uncured unit. In FIG. 1 there is depicted a plate or sheet, 11 upon which there has been deposited three layers of ceramic material 13. In the preferred embodiment, the ceramic material is a low dielectric constant material, commonly known as NPO (Negative, Positive, Zero), but other forms of ceramic material could be used. The ceramic material is formed into a slurry and silk screened, screen printed, or doctor bladed one layer at a time, with partial drying between each layer and after the last layer has been screened. Although in FIG. 1, three layers are shown, different numbers of layers could be deposited as the base depending upon how the end product is to be used and upon the ceramic material. After the three layer thickness of wet ceramic material 13 has been deposited and partially dried on the plate or screen 11, a pattern of resistance material 15 is silk screened, screen printed, or doctor bladed, on the uppermost surface of the base thickness of the partially dried ceramic 13. In the preferred embodiment the resistance material pattern consists of stripes such as stripes 15 and 16 shown in FIGS. 3 and 4. The resistance material in the preferred embodiment is a glass frit with noble metal conductive particles therein, although it could be other material, provided such material conducts electricity with a determinable impedance thereto and with a determinable temperature coefficient of resistance. The resistance material is applied in a wet form, similar to a heavy ink, and is partially dried between layers in the same fashion as the ceramic layers.

Returning to FIG. 1, we find that on top of the pattern of partially dried resistance material, there are three more layers of ceramic material 17 deposited. In the preferred embodiment, the upper thickness of ceramic material 17 is identical to the base thickness 13, however different thicknesses could be arranged if there were some advantage thereto. For instance, the upper thickness of ceramic material could be four or five layers thick. The ceramic material of the upper thickness is also NPO in the preferred embodiment. It should be noted that such a dielectric cover layer adds to performance capability of the chip resistor, since it enhances performance due to the added passivation or oxide prevention means.

Figure 3:
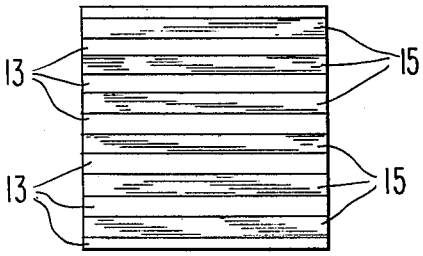
FIG. 3 is a schematic top view of stripes of resistance material printed on a thickness of ceramic.
Figure 5:
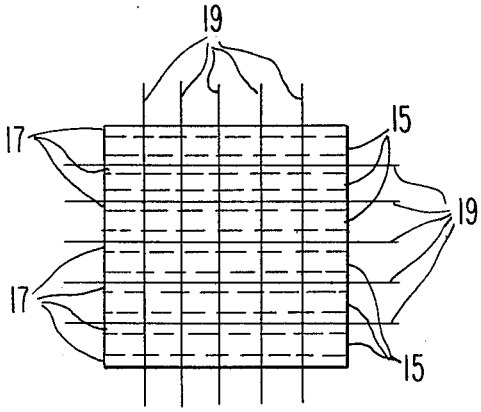
FIG. 5 is a schematic top view of a basic unit, with the resistance material stripes shown in phantom and showing the paths along which the unit is diced.

After the basic unit shown in FIG. 1 has been built in its initially dried state, i.e. before it is fired, or cured, it is given a final drying at which point it has a chalk like consistency. It is then diced or cut into chips. Examine FIGS. 3 and 5. In FIG. 3 the top view of the base thickness 13 is shown with the resistance material pattern 15 printed thereon. In FIG. 5, a top view of the basic unit of FIG. 1 is shown with the resistance material pattern 15 shown in phantom. The basic unit in its finally dried state is cut along the lines 19. It will be noted by examining FIG. 5, that within each square of the basic unit defined by the lines 19, there is a section of the resistance material 15 (in phantom) sandwiched between the upper and lower thicknesses of the wet ceramic.

After the basic unit has been cut into chips, the chips are removed from the base plate or sheet and placed on a high temperature sagger or boat to facilitate the firing process. The sagger or boat with the contained chips are then placed into an oven or kiln and fired in a cycle ranging from 2 to 8 hours depending on the materials used and with a cycle so as to avoid cracking of the materials due to thermal shock. The firing temperature may range from 750° C. to 1300° C. depending on the materials used. Other temperatures and times could be employed if different materials are used.

Figure 6:
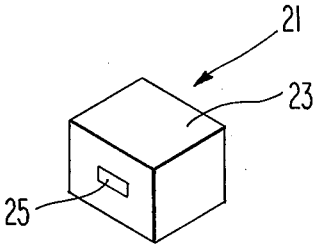
FIG. 6 is a pictorial schematic of a cured chip resistor without termination means.

When the basic unit has been diced into chips, and fired there results a plurality of chips, such as the chip 21, depicted in FIG. 6. The chip 21 consists of a solid ceramic housing 23, within which there is disposed a stripe section of electrical resistance material 25. The stripe of electrical resistance material 25 extends to both ends of the chip.

Figure 7:
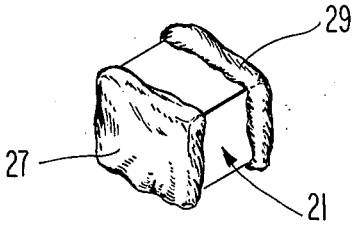
FIG. 7 is a pictorial schematic of the chip resistor of FIG. 6 with termination means secured thereto.

After the basic unit has been hardened by firing and the plurality of chips, such as chip 21, has been created, each of such chips has a termination means secured thereto. In FIG. 7, there is shown the chip 21 with the termination means 27 and 29 secured thereto. In the preferred embodiment the termination means 27 and 29, are palladium-silver material which is deposited on the ends of the chip 21. The palladium-silver material when cured forms an integral part of, or connection with, the resistance material stripe 25. One the chip 21 has had termination ends secured thereto, it is a complete resistor chip.

Figure 4:
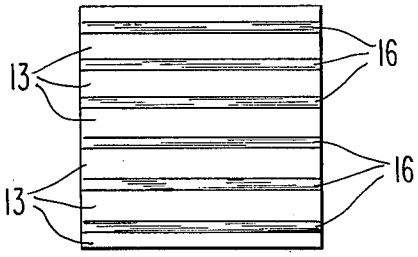
FIG. 4 is a schematic top view of stripes of resistance material wherein said stripes are narrower than the stripes of FIG. 3.

In the description, it has been indicated that the resistance material is printed on the dired ceramic base in stripes. Actually, other patterns could be printed if such other patterns were useful. In this area of the discussion it should be noted that the stripes 16 of FIG. 4 are narrower than the stripes of FIG. 3. If it is the purpose of the user to develop a resistor of greater resistance than that shown by the chip section of FIG. 3, then the stripes can be made narrower (the depth of the resistance material need not be altered) as shown in FIG. 4.

Figure 2:
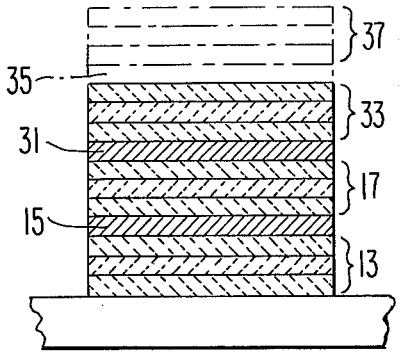
FIG. 2 is a cross sectional view of a basic unit with a second layer of resistance material thereon and a plurality of layers of ceramic material overlaying said second layer of resistance material.

It should also be understood, and as is apparent from FIG. 2, that the resistance package can be made of more than one layer of resistance material. As can be seen in FIG. 2, the basic unit can be fabricated as shown in FIG. 1 and described above. In FIG. 2 there is shown a second electrical resistance material pattern 31, printed on the upper surface of the second thickness 17. As can further be seen in FIG. 2, a third thickness of ceramic material 33 is deposited on top of the second electrical resistance material pattern 31 to form the package shown in FIG. 2. The package shown in FIG. 2 is thereafter cut into chips as described in connection with FIG. 5. Thereafter the package of FIG. 2 is fired and the chips result in having two sections of resistance material, one located above the other. Such resistance stripes can be connected in parallel when the termination means, such as means 27 and 29 are secured thereto.

Figure 8:
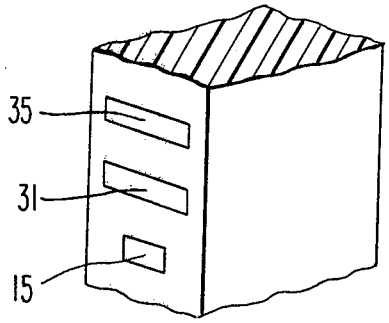
FIG. 8 is a pictorial schematic of a cured chip with electrical means to provide an R-C circuit.
Figure 9:
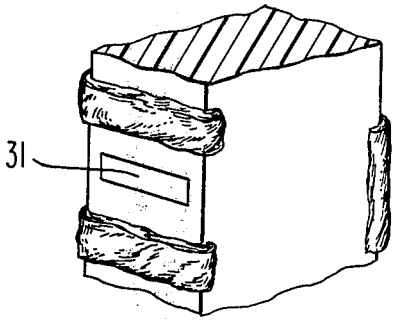
FIG. 9 is a pictorial schematic of the chip of FIG. 8 with termination means secured thereto.

As can readily be understood, in order to obtain a wider plate for capacitor purposes, the second pattern can be a wider pattern of electrical conducting material rather than stripes and a third pattern 35, shown in phantom, in the form of a wider pattern of electrical conducting material rather than stripes can be deposited on the upper side of thickness 33. Thereafter a fourth thickness of ceramic material 37 can be deposited on the third resistance material pattern (also shown in phantom). Then the chips which are fabricated from the foregoing package takes the form of a capacitor (from sections of patterns 35 and 31 separated by a section of ceramic 33) and a resistor (from a section of pattern 15) housed in the same chip. By properly connecting the termination means to such a chip, the chip can be made into a R-C circuit. For instance if termination means 27 and 29 were connected to the package of FIG. 2, the termination means 29 would connect layer 15 to layer 31, while termination means 27 would make separate connections to layers 15 and 35 such as shown in FIG. 8 and FIG. 9.

It should be understood that for purposes of easy understanding, the drawings exaggerate the depth of the layers of the material. In the preferred embodiment the depth of each layer of thickness 13 is less than 1 mil (0.001"), while the depth of the resistance material pattern 15 is between ¼ and 1 mil, but could be less or greater. It should be further understood that in partial drying the wet ceramic layers can be exposed to a heat source, such as a heat lamp, for a sufficient time so that the material is transformed from a slurry to a material with sufficient rigidity to support another screened layer.

The time and temperature varies with the material. The further drying or final drying is effected in a low temperature oven with temperatures in the 150° C. to 160° C. range for cycles of 2 to 4 hours.

What I claim is:

1. A method for making a chip circuit component comprising the steps of: depositing individually a first plurality of thin layers of wet ceramic material in a stacked form on a sheet means and partially drying each of said thin layers of ceramic between each layer deposition thereof; depositing a pattern of electrical resistance material in a wet form onto the uppermost, partially dried, ceramic layer in said stack and partially drying said electrical resistance material; depositing individually a second plurality of thin layers of wet ceramic material in a stacked form onto the partially dried electrical resistance material and partially drying each of said thin layers of ceramic between each layer deposition thereof; further drying the above described stack consisting of the partially dried first plurality of ceramic layers, the partially dried electrical resistance material and the partially dried second plurality of ceramic layers; cutting the further dried, above described, stack into a plurality of chips each of which has a section of said electrical resistance material and abutting two edges thereof surrounded by dried ceramic material, firing said plurality of chips until the ceramic material is hardened into a solid ceramic housing; and securing terminal means to said two edges of the ceramic material and forming said terminal means integral with the resistance material disposed in said solid ceramic housing.

2. A method for making a chip circuit according to claim 1 wherein there is further included prior to said further drying step, the steps of: depositing a first pattern of electrical conducting material in a wet form onto the uppermost surface of said partially dried ceramic layer of said second plurality of ceramic layers and partially drying said first pattern of electrical conducting material, depositing individually a third pluraity of thin layers of wet ceramic material in a stacked form onto the partially dried first pattern of electrical conducting material and partially drying each of said thin layers of ceramic between each layer deposition thereof; depositing a second pattern of electrical conducting material in a wet form onto the surface of the uppermost of said partially dried ceramic layers of said third plurality of ceramic layers and partially drying said second pattern of electrical conducting material; depositing individually a fourth plurality of thin layers of wet ceramic material in a stacked form onto the partially dried second pattern of electrically conducting material and partially drying each of said thin layers of ceramic material between each layer deposition thereof; said further drying steps including further drying of the above described stack consisting of the partially dried first plurality of ceramic layers, the partially dried electrical resistance material, the partially dried second plurality of ceramic layers, the partially dried first pattern of electrical conducting material, the partially dried third plurality of ceramic layers, the partially dried second pattern of electrical conducting material and the partially dried fourth plurality of ceramic layers; said cutting step including cutting the further dried, above described, stack so that each of said plurality of chips has a section of said electrical resistance material and each has sections of each of said first and second electrical conducting material abutting two edges thereof.

* * * * *